United States Patent [19]

Anderson et al.

[11] 3,984,514

[45] Oct. 5, 1976

[54] PROCESS FOR PRODUCING FINE POLYAMIDE/POLYSTYRENE FIBERS

[75] Inventors: Raymond Paul Anderson; Francis Ross Galiano, both of Overland Park, Kans.

[73] Assignee: Gulf Research & Development Company, Pittsburgh, Pa.

[22] Filed: Jan. 24, 1972

[21] Appl. No.: 220,482

[52] U.S. Cl. ..... 264/147; 264/148; 264/151; 264/210 F; 264/DIG. 47

[51] Int. Cl.[2] ..... B29H 7/18

[58] Field of Search ..... 260/857 L; 264/DIG. 47, 264/210, 171, 288–290, 146, DIG. 29, 147, 151, 210 F, 148

[56] References Cited

UNITED STATES PATENTS

| | | | |
|---|---|---|---|
| 2,327,087 | 8/1943 | Austin | 264/146 |
| 2,954,587 | 10/1960 | Rasmussen | 264/DIG. 47 |
| 3,099,067 | 7/1963 | Merriam et al. | 28/82 |
| 3,336,174 | 8/1967 | Dyer et al. | 264/DIG. 47 |
| 3,359,344 | 12/1967 | Fukashima et al. | 260/857 L |
| 3,382,305 | 5/1968 | Breen | 264/171 |
| 3,402,548 | 9/1968 | Winninger et al. | 264/DIG. 47 |
| 3,423,888 | 1/1969 | Brown | 264/DIG. 47 |
| 3,499,822 | 3/1970 | Rasmussen | 260/857 L |
| 3,505,429 | 4/1970 | Press | 260/857 L |
| 3,516,961 | 6/1970 | Robb | 260/857 L |
| 3,539,662 | 11/1970 | Hill et al. | 260/857 OL |
| 3,576,931 | 4/1971 | Chopra et al. | 264/177 F |
| 3,608,042 | 9/1971 | Rasmussen | 264/177 R |
| 3,645,085 | 2/1972 | Rassart | 264/210 R |

FOREIGN PATENTS OR APPLICATIONS

| | | | |
|---|---|---|---|
| 43-542 | 1/1968 | Japan | 264/DIG. 29 |
| 43-13348 | 6/1968 | Japan | 264/DIG. 29 |

*Primary Examiner*—Jay H. Woo
*Attorney, Agent, or Firm*—Richard L. Kelly

[57] ABSTRACT

A process is disclosed for producing extremely fine polyamide/polystyrene fibers which include the steps of forming a molten blend consisting of from about 35 weight percent up to about 45 weight percent of a polyamide, preferably polycaprolactam and, correspondingly, from about 65 weight percent down to about 55 weight percent of a polystyrene, forcing this molten blend through an extrusion die to form a structure such as a strand, monofilament, sheet or film, melt drawing the extruded structure at a draw ratio of at least 4:1 to orient the same and thereby obtain a fibrillatable structure, and thereafter mechanically fibrillating the oriented, fibrillatable structure by cold drawing whereby the structure spontaneously and completely breaks up into extremely fine polyamide/polystyrene fibers. The blend may optionally additionally contain up to about 15 weight percent of an ethylene/acrylic acid copolymer containing about 20 weight percent acrylic acid.

4 Claims, No Drawings

PROCESS FOR PRODUCING FINE POLYAMIDE/POLYSTYRENE FIBERS

BACKGROUND OF THE INVENTION

1. Field of the Invention

The invention disclosed herein relates to a previously unknown method and improved process for producing a continuous bundle of small diameter, extremely fine fibers of a blend or dispersion of two polymers, one of which is not normally considered to be a fiber-forming polymer. This invention additionally pertains to the compositions and the dispersions or blends thereof from which the fibers of the invention may be formed by a fibrillation process. More specifically, the invention relates to a process for obtaining extremely fine polyamide/polystyrene fibers by fibrillation from an extruded blend consisting of a polyamide and a polystyrene, said blend being limited to a very specific and narrow range of polyamide and polystyrene.

2. Description of the Prior Art

In the prior art, it is known to blend or mix polymers and copolymers and then form or produce filaments from the mixture or blend by extruding the molten blend or a solution of the blend either through a conventional die orifice or a spinneret, as for instance disclosed in U.S. Pat. No. 3,330,899 to Fukushima et al. The prior art also discloses the producing of a non-continuous fibril within a filament by extruding a dispersion of two immiscible materials and then drawing the extrudate. Additionally, it is known to extrude a mixture or dispersion of two materials, then extract one of them to form a microporous filament. It is also known in the prior art to make filaments or fibers by extruding a sheet, film, strand or monofilament of the fiber-forming material, then optionally treating it with a solvent to weaken the same at crystal cleavage points and finally mechanically breaking the structure into noncylindrical fibers. However, no process or composition is disclosed in the prior art which creates a continuous fibril mass of crystalline oriented, extremely fine fibrils which without resort to carding can be easily twisted into yarn. Most of the processes and methods of the prior art that require or make use of a mechanical beating or breaking up of an extruded sheet, film, strand or monofilament result in a noncylindrical, sharp-edged and irregular fibers. Other known processes and methods are limited to fibers of a size proportional to the orifice through which they are extruded.

It is additionally known in the prior art to fibrillate thermoplastic, uniaxially oriented films or tapes of polyethylene, polypropylene, nylon and other materials by stretching and annealing of the thermoplastic film under specific conditions of temperature, draw ratio and annealing temperature, then passing the drawn film across or through a mechanical working means so that the uniaxially oriented film is rubbed, twisted, braided, scraped or punctured or a combination of these actions to cause fibrillation of the film. It has also been disclosed that sonic means such as a sonic probe may be used to cause fibrillation of drawn film.

However, certain thermoplastic films or strands such as nylon, even when drawn, are very difficult to fibrillate. When these nylon structures are subjected to the fibrillation techniques of the prior art, they often break rather than fibrillate because the tension of the film or strand across the fibrillator must be great in order to get a severe enough action with the prior known fibrillators to fibrillate the film or strand. Nylon strands, monofilaments, tapes, sheets and films prepared by the previously known methods and those taught in the prior art are difficult to fibrillate except under extreme conditions. These nylons must normally be uniaxially oriented by stretching under specific conditions of temperature, draw ratio and annealing temperatures and then subjected to severe mechanical workings in order that they may be fibrillated at all. However, the nylon structures prepared by the methods of this invention and from the blended compositions thereof can be readily fibrillated by the processes of this invention which are much simpler and more economical than many of the conventional methods previously employed and taught by the prior art.

SUMMARY OF THE INVENTION

It has been found that extremely fine polyamide/polystyrene fibers can be produced by a relatively simple fibrillation process as disclosed herein if the process is begun with a very definite and very limited, specific, narrow range of a polyamide and polystyrene blend or dispersion as set forth hereinbelow. These extremely fine fibers are obtainable from a blended composition or dispersion of a polyamide and a polystyrene by the fibrillation process of the invention when the initial or starting dispersion or blended composition consists of from about 55 weight percent up to about 65 weight percent of a polystyrene and, correspondingly, from about 45 weight percent down to about 35 weight percent of a polyamide. In one embodiment of the invention, the polyamide employed was a polycaprolactam.

The process of the invention by which the extremely fine polyamide/polystyrene fibers are obtained by fibrillation is initiated or begun by first obtaining a polyamide/polystyrene dispersion or blended composition within the range as set forth hereinabove. Such a blend of the polyamide/polystyrene may be attained by numerous means, such as by melt blending or dispersing the two initial or beginning polymers in an extruder or other conventional mixing or blending device. Once the blended composition has been obtained, the same is extruded through a die to form a structure such as a strand, monofilament, sheet, film or the like and then is structure, as the same is being extruded from the die, is hot or melt drawn to orient the same. In a preferred embodiment, the melt or hot drawing is carried out until a draw ratio of at least 4:1 is attained. The resultant oriented structure is then readily fibrillatable by mechanical means to yield extremely fine polyamide/polystyrene fibers. The mechanical fibrillation of the oriented structure may be carried out in numerous ways; a preferred method being to cold draw or further orient at ambient temperatures the strand, monofilament, sheet or film whereby the same breaks up spontaneously and completely into extremely fine polyamide/polystyrene fibers. Another means for fibrillating the extruded and drawn structure whereby the same breaks up completely into extremely fine fibers is to chop, cut or pelletize the structure into short lengths of small width and then suspend same in a nonsolvent liquid and beat in a mechanical beating apparatus such as a Waring blender.

It has additionally been discovered that if a small amount of an ethylene/acrylic acid copolymer is incorporated into the beginning or starting polyamide/polystyrene blend from which the fibers are produced, the resultant fibers are of improved quality in that the fibril pulp obtained upon fibrillation, such as in a Waring blender, of the extruded and melt oriented structure is finer and more uniform, containing less coarse material. In one embodiment, the ethylene/acrylic acid copolymer employed contained approximately 80 weight percent polymerized ethylene and 20 weight percent polymerized acrylic acid. The ethylene/acrylic acid copolymer added to the polyamide/polystyrene blend may be beneficially employed up to about 15 weight percent to impart improvements in the resulting polyamide/polystyrene fibers and the products produced therefrom.

One of the uses or utilities of the polyamide/polystyrene fibers produced by the process of this invention from the blended compositions thereof is the fabrication or making of paper or other nonwoven sheet-like structures or materials on paper-making machinery by known paper-making processes. These extremely fine fibers can be converted into nonwovens or paper sheets of good quality which possess an appearance and feel of conventionally made paper. In converting the fibers obtained by this invention into paper handsheets, it was observed that the paper sheets made or produced from the fibers obtained from the polyamide/polystyrene blend which included a small amount of the ethylene/acrylic acid copolymer therein were of improved quality. The paper sheets so produced showed improvements over those produced without the ethylene/acrylic acid copolymer in the initial blend in that their strength was increased and that the surface of the sheet was smoother and of a softer hand.

Fibers made from polyamides are known to have excellent properties but one serious disadvantage which has limited their use in paper or nonwovens is the high price of polyamide fibers. The present invention circumvents this drawback to a large extent as the expensive polyamide component is diluted with a more than equal proportion of the relatively inexpensive component, polystyrene. Although the fibers of this invention contain a major proportion of polystyrene, most of the desirable properties of the polyamide fibers are maintained. The lower softening temperature of the polystyrene component may be beneficial in some applications, e.g., in heat sealing or in increasing the strength of a paper or nonwoven by thermal bonding.

DETAILED DESCRIPTION OF THE PREFERRED EMBODIMENTS

The improved process of the invention and the extremely fine fibers obtained thereby are illustrated with greater particularity by the inclusion of the following specific examples. These examples are intended to be illustrative of the invention only and are not intended to limit the same in any way.

EXAMPLE 1

This example illustrates the process of the invention and the extremely fine fibers produced thereby from the composition employed in the process.

A starting blend of 55 weight percent polystyrene and 45 weight percent polyamide was prepared by placing 55 parts of polystyrene (Dow Styron 666, a commercial polystyrene having a molecular weight of about 150,000) and 45 parts of polyamide (Gulf Nylon NX 3013, a polycaprolactam having a molecular weight of about 25,000) in a Brabender Sigma mixer head heated to 250°C. The composition was then melted and mixed until the melt appeared homogeneous, which point was reached after a period of approximately 10 minutes. This blend was then removed from the mixer and after cooling was ground.

A monofilament was then prepared from this blend by extrusion of the same at 235°C. through a die having a circular cross section and an orifice diameter of approximately 0.083 inches. The monofilament as extruded was passed through a pair of draw-down rolls and then to take-up roll. The draw-down rolls were operated at a rate such that the molten strand emerging from the die was stretched until the diameter of the finished monofilament was approximately ¼ that of the die orifice; equivalent to a draw ratio of about 16:1.

After the monofilament was cooled, it was placed under tensile stress at ambient temperatures for further orientation. When this monofilament was thus stretched at ambient temperatures, it broke up spontaneously and completely into extremely fine fibers of a diameter of approximately 3 microns.

EXAMPLE 2

In this example, extremely fine fibers were produced from an extruded monofilament as in Example 1 with one exception. The exception in this example was that the blend consisted of 60 weight percent polystyrene (Dow Styron 666) and 40 weight percent polyamide (Gulf Nylon NX 3013). Upon drawing of the cooled monofilament at room temperature, the same broke up completely to yield extremely fine fibers as in Example 1.

In an additional experiment, substantially identical to that set forth above in this example, with the exception that the 60 weight percent polystyrene (Dow Styron 666) was replaced with 60 weight percent of a higher molecular weight polystyrene (Dow Styron 690, a commercial polystyrene having a molecular weight of about 180,000), identical results were obtained in that extremely fine fibers were obtained upon cold drawing of the monofilament produced from the polystyrene/polyamide blend.

In yet another experiment, substantially identical to the above Example 2, with the exception that the 40 weight percent polyamide (Gulf Nylon NX 3013) was replaced with a higher molecular weight polyamide (BASF Ultramide B-4, a commercial polycaprolactam having a molecular weight of about 37,000), similar results were obtained in that the monofilament produced from the polystyrene/polyamide blend broke up completely into extremely fine fibers upon cold drawing.

EXAMPLE 3

In this example, a monofilament was produced from a blend of 65 weight percent polystyrene (Dow Styron 666) and 35 weight percent polyamide (Gulf Nylon NX 3013) in a manner identical to that set forth in Example 1. The resultant monofilament after hot drawing and cooling as in Example 1 was subjected to further drawing or tensile stress at ambient temperatures. When the cooled monofilament was thus stretched, it broke up completely to yield extremely fine fibers.

EXAMPLE 4

This example illustrates the use of a blend containing a lower amount of the polystyrene which is not satisfactory in the process of the invention.

A blend containing 50 weight percent polystyrene (Dow Styron 666) and 50 weight percent polyamide (Gulf Nylon NX 3013) was prepared as in Example 1. A monofilament was then produced from this blend and hot drawn as described in Example 1. After the monofilament was cooled, further orientation was attempted at room temperatures. The monofilament would stretch until a breaking occurred but the monofilament could not be completely converted into extremely fine fibers as were obtained in the previous Examples 1 through 3, inclusive. There were, however, many fine fibers at the point of break of the monofilament.

In a second experiment similar to that set forth in the above Example 4 but employing a blend containing 40 weight percent polystyrene (Dow Styron 666) and 60 weight percent polyamide (Gulf Nylon NX 3013), similar results were obtained in that the monofilament would break but could not be converted into fine fibers as were obtained in Examples 1 through 3, inclusive. Again, though, there were fine fibers at the point of break in the monofilament, but in this second experiment, there was a smaller number of these fine fibers at the point of break than in the previous experiment of Example 4.

EXAMPLE 5

This example illustrates the use of a blend containing a higher level of polystyrene which is not satisfactory in the process of the invention.

A blend containing 70 weight percent polystyrene (Dow Styron 666) and 30 weight percent polyamide (Gulf Nylon NX 3013) was prepared as in Example 1. A monofilament was produced from this blend and hot drawn as in Example 1. After cooling, additional drawing of the monofilament to produce further orientation was attempted. It was found that the monofilament was too brittle for further good orientation with the result that it could not be satisfactorily converted into extremely fine fibrils as obtained in Examples 1 through 3, inclusive.

EXAMPLE 6

This example is similar to Example 1 with the exception that the blend was prepared in an extruder rather than in a mixing head.

A blend consisting of 55 weight percent polystyrene (Dow Styron 666) and 45 weight percent polyamide (Gulf Nylon NX 3013) was prepared by mixing 55 parts by weight of the polystyrene pellets and 45 parts by weight of the polyamide pellets and then extruding the mixed pellets through a twin screw extruder. The extruded strand was passed through a water cooling trough to cool the same and was then chopped and dried. A monofilament was then prepared from this blend as in Example 1 with hot drawing. After cooling and further drawing of the monofilament to produce additional orientation therein, the monofilament broke up spontaneously and completely into extremely fine fibers having a diameter of about 3 microns as in Example 1.

EXAMPLE 7

This example is included to illustrate the fact that monofilaments of the blended composition within the range of the invention may also be converted to fibers by means other than by cold drawing and further orientation of the monofilament. One of these other means illustrated by this example is a mechanical beating action.

A blend of 55 weight percent polystyrene (Dow Styron 666) and 45 weight percent polyamide (Gulf Nylon NX 3013) was prepared by extruding a mixture of the two through a 1 inch Killion laboratory extruder. The following temperatures and conditions were employed in the extruder when the blended strand was extruded therefrom: Zone 1, 210° C.; Zone 2, 265° C.; die, 222° C.; screw speed, 20.5 rpm. The resultant blended strand having a diameter of 0.075 inch was then cut or chopped into ¼ inch lengths. The chopped pellets from the blended strand were suspended in isopropanol and were then reduced to fiber by beating for approximately 10 minutes in a Waring blender which was cooled to prevent overheating.

One of the utilities or uses of the extremely fine polyamide/polystyrene fibers obtained by the process of this invention is in the making or preparation of paper or other nonwoven sheet-like structures or materials on paper-making machinery, which may be manaufactured by known paper-making processes. Therefore, a paper handsheet was prepared from the fibers obtained in this example on a Noble and Wood sheet-forming machine. To obtain the paper handsheet, the above-obtained fibers were slurried and this slurry of polyamide/polystyrene fibers was poured into the head box of the Noble and Wood sheet-forming machine. A paper handsheet was then formed thereon by the usual and normal methods employed in the use of this sheet-forming machine.

EXAMPLE 8

Fibers were obtained in this example similar to those obtained in Example 7 with the exception that the blend was extruded in sheet form rather than in the form of a strand.

The blend as set forth in Example 7 was extruded through a 1 inch Killion laboratory extruder under the conditions set forth in that example with the exception that the circular die was replaced with a sheet die. As the molten blend exited the die in sheet or web form, it was picked up and run over a chilled roll which was run at a rate such that the same orientation was produced in the molten web as was produced in the strand of Example 7. The resultant extruded sheet, after cooling, was cut into pieces of ¼ inch length in the machine or extrusion direction, which were then reduced to fiber by being suspended in isopropanol and beating in a Waring blender. These fibers were then converted into paper handsheets on the Noble and Wood sheet-forming machine as set forth in Example 7. The fibers produced in this example were more uniform and the paper handsheets fabricated therefrom were of equal or better quality than those obtained in Example 7.

EXAMPLE 9

It has also been found that a fiber of improved quality and paper handsheets of improved properties may be obtained if a small amount of a low molecular weight ethylene/acrylic acid copolymer is added to the polyamide/polystyrene blend prior to extrusion thereof.

A mixture and then a blended strand was prepared in this example as in Example 7 with the exception that the starting mixture or composition consisted of 55 parts polystyrene (Dow Styron 666), 45 parts polyamide (Gulf Nylon NX 3013) and 10 parts of an ethylene/acrylic acid copolymer (Union Carbide EAA 9300, a copolymer having a melt index of 50 and containing 80 weight percent ethylene and 20 weight percent acrylic acid). The strand extruded from the blend was chopped into ¼ inch length pellets and reduced to fibers as in Example 7. The fibers obtained in both Examples 7 and 9 were submitted to a microscopic examination and comparison from which it was determined that the fibers obtained in this Example 9 were of an improved quality, this being concluded from the fact that the pulp of Example 9 was finer, more uniform and contained much less coarse material. A paper handsheet was prepared on the Noble and Wood sheet-forming machine from the fibers obtained in this example by the method employed in Example 7. A paper sheet so produced also showed some improvement, which was evident from the fact that the sheet was of greater strength and the surface thereof was both softer and smoother.

EXAMPLE 10

This example illustrates the fact that when the polystyrene level within the polyamide/polystyrene blend drops from 55 weight percent to 50 weight percent, the fibers obtained from the blend are coarser and much less useful than the fibers obtained from blends wherein the polystyrene is present in an amount of from about 55 weight percent up to about 65 weight percent as, for example, illustrated in Example 9.

A blend was prepared from a mixture consisting of 50 parts polystyrene (Dow Styron 666), 50 parts polyamide (Gulg Nylon NX 3013) and 10 parts of an ethylene/acrylic acid copolymer (Union Carbide EAA 9300, a copolymer having a melt index of 50 and containing 80 weight percent ethylene and 20 weight percent acrylic acid). The mixture was converted to a blended strand by extrusion through a 1 inch Killion laboratory extruder under the conditions set forth in Example 7 and then chopped into ¼ inch pellets. The chopped pellets were reduced to fibers by suspension in isopropanol and beating for approximately 10 minutes in a Waring blender which was cooled to prevent overheating. The resultant fibers were coarser and much less useful than those obtained in either Example 7 or Example 9.

EXAMPLE 11

We have found that further improvements in the properties of the paper sheets produced from the fibrils obtained by this invention may be brought about by the addition of binders as are used and as is commonly the practice in the production of nonwoven fabrics. The binders which may be used are those typically used in nonwovens, e.g., acrylic latexes, vinyl acetate latexes or styrenebutadiene latexes. The binders may be added by conventional methods used in nonwoven technology. This example illustrates the use of a binder in the preparation of a paper sheet made from the fibrils obtained by the invention.

A fiber slurry was prepared from the fibrils obtained in Example 9 and fed to the head box of the Noble and Wood sheet-forming machine, after which sheet formation thereon was carried out by the usual and normal methods employed in the use of this sheet-forming machine. However, while the wet sheet was still on the wire screen portion of this sheet-forming machine, it was saturated with an acrylic latex binder (Union Carbide Ucar 865, diluted with water to contain 15 weight percent solids). This saturated sheet was then removed from the screen, pressed to remove excess binder and dried on a drum at 90°C. The resultant dried sheet exhibited greatly improved strength. Similar results were obtained when other acrylic latexes were used as binders, e.g., Ucar 891, Rhoplex B-5 and Rhoplex K-3 (Rohm & Haas).

While only certain preferred embodiments of this invention have been described and illustrated by way of example, many modifications within the true spirit and scope of this invention and within the following claims will occur to those skilled in the art.

1 What is claimed as new and what it is desired to secure by Letters Patent of the United States is:

1. A process for producing extremely fine polyamide/polystrene fibers comprising the steps of:

a. forming a molten blend consisting essentially of from about 35 weight percent up to about 45 weight percent of a polycaprolactam and, correspondingly, from about 65 weight percent down to about 55 weight percent of a polystyrene;

b. forcing said molten blend of step (a) through an extrusion die to form a structure such as a strand, monofilament, sheet or film;

c. drawing the melted structure of step (b) to a degree such that its cross-sectional area is not more than ¼to the cross-sectional area of the die orifice from which it was extruded;

d. cooling the drawn structure from (c) to ambient temperature; and e. cold drawing the structure from (d) until it breaks up into extremely fine polyamide/polystyrene fibers.

2. The process as set forth in claim 1 wherein said molten blend of step (a) contains up to about 15 weight percent of low molecular weight ethylene/acrylic acid copolymer, said ethylene/acrylic acid copolymer containing approximately 80 weight percent polymerized ethylene and 20 weight percent polymerized acrylic acid.

3. A process for producing extremely fine polyamide/polystyrene fibers comprising the steps of:

a. forming a molten blend consisting essentially of from about 35 weight percent up to about 45 weight percent of a polycaprolactam and, correspondingly, from about 65 weight percent down to about 55 weight percent of a polystyrene;

b. forcing said molten blend of step (a) through an extrusion die to form a structure such as a strand, monofilament, sheet or film;

c. drawing the melted structure of step (b) to a degree such that its cross-sectional area is not more than ¼ the cross-sectional area of the die orifice from which it was extruded;

d. cooling the drawn structure from (c) to ambient temperature;

e. chopping the strands from (d) into a plurality of discrete lengths; and f. suspending the chopped strands from (e) in a nonsolvent liquid and mechanically beating same whereby said discrete lengths of said structures break up into extremely fine polyamide/polystyrene fibers.

4. The process as set forth in claim 3 wherein said molten blend of step (a) contains up to about 15 weight percent of a low molecular weight ethylene/acrylic acid copolymer, said ethylene/acrylic acid copolymer containing approximately 80 weight percent polymerized ethylene and 20 weight percent acrylic acid.

* * * * *